United States Patent [19]

Wilkinson

[11] Patent Number: 4,686,727

[45] Date of Patent: Aug. 18, 1987

[54] CONVENIENCE BAR ASSEMBLY FOR HOSPITAL BED

[75] Inventor: Lawrence H. Wilkinson, 718 Encino N.E., Albuquerque, N. Mex. 87102

[73] Assignee: Lawrence H. Wilkinson, Albuquerque, N. Mex.

[21] Appl. No.: 740,423

[22] Filed: Jun. 3, 1985

[51] Int. Cl.[4] ..... A47C 21/00

[52] U.S. Cl. ..... 5/503; 5/507; 5/508

[58] Field of Search ..... 5/414, 60, 503–508, 5/445, 424; 248/105, 106

[56] References Cited

U.S. PATENT DOCUMENTS

| | | | |
|---|---|---|---|
| 575,711 | 1/1897 | Haley | 5/507 |
| 798,114 | 8/1905 | Rosenthal | 5/445 |
| 826,978 | 7/1906 | Whittington . | |
| 837,642 | 12/1906 | Powell | 5/503 |
| 884,398 | 4/1908 | Keasey . | |
| 1,297,043 | 3/1919 | Travis | 5/508 |
| 1,376,247 | 4/1921 | Bishop | 5/445 |
| 1,505,437 | 8/1924 | Schweizer . | |
| 1,704,979 | 3/1929 | Kusterle et al. | 5/508 |
| 2,595,449 | 5/1952 | Coffing et al. | 5/505 |
| 2,696,963 | 12/1954 | Sheperd | 5/503 |
| 2,749,196 | 6/1956 | Wolfe | 5/507 |
| 3,286,283 | 11/1966 | Bertoldo . | |
| 3,310,817 | 3/1967 | Harding . | |
| 3,739,793 | 6/1973 | Wilson . | |
| 4,253,207 | 3/1981 | Marcyan | 5/445 |
| 4,262,872 | 4/1981 | Kodet | 5/503 |

FOREIGN PATENT DOCUMENTS

| | | | |
|---|---|---|---|
| 789207 | 6/1968 | Canada | 5/508 |
| WO82/02832 | 9/1982 | PCT Int'l Appl. | 5/60 |

*Primary Examiner*—Gary L. Smith
*Assistant Examiner*—Michael F. Trettel
*Attorney, Agent, or Firm*—Bernard, Rothwell & Brown

[57] ABSTRACT

A convenience bar assembly for a hospital bed includes a generally U-shaped member including two arms adapted for generally vertical orientation and a horizontal cross-member connecting the arms. The lowermost ends of the arms of the U-shaped member are attached to opposite sides of a bed so that the horizontal member is oriented over the bed transversely. A horizontal support bar is swingably connected to the horizontal cross-member so that the horizontal support bar hangs below the horizontal cross member when the horizontal support bar is at rest.

16 Claims, 10 Drawing Figures

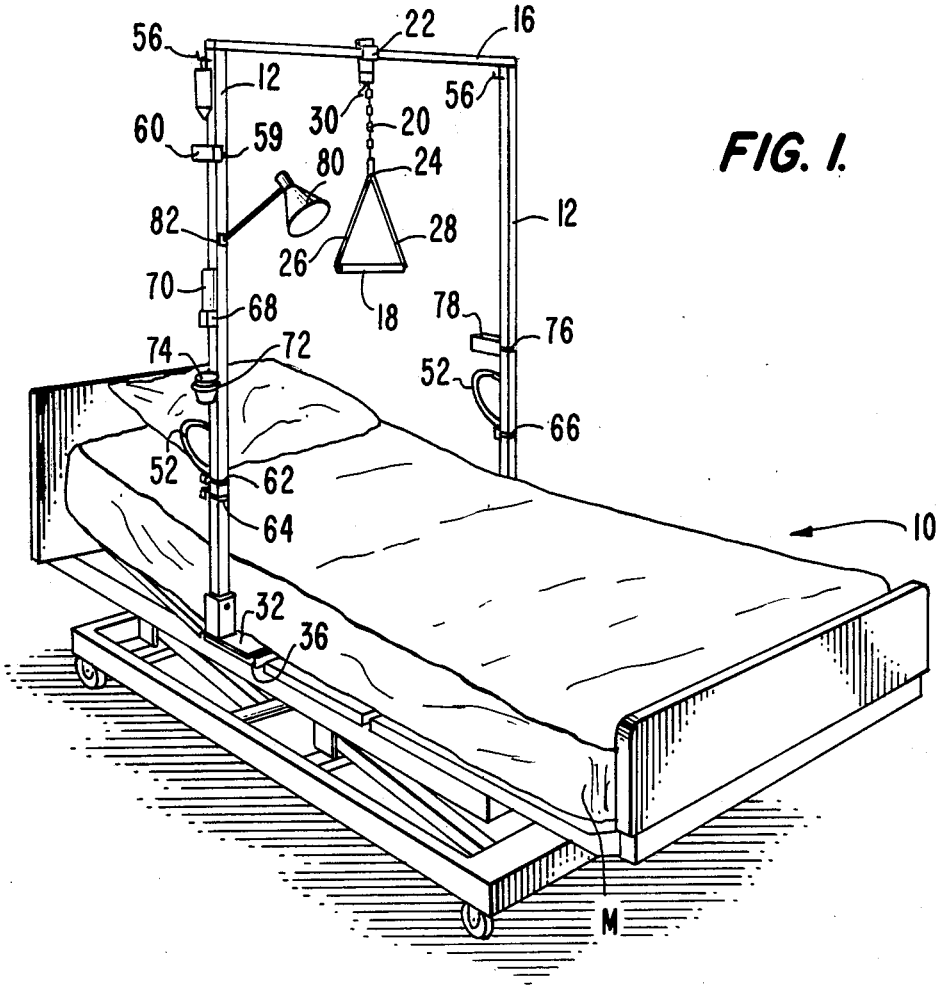
FIG. 1.
FIG. 2.
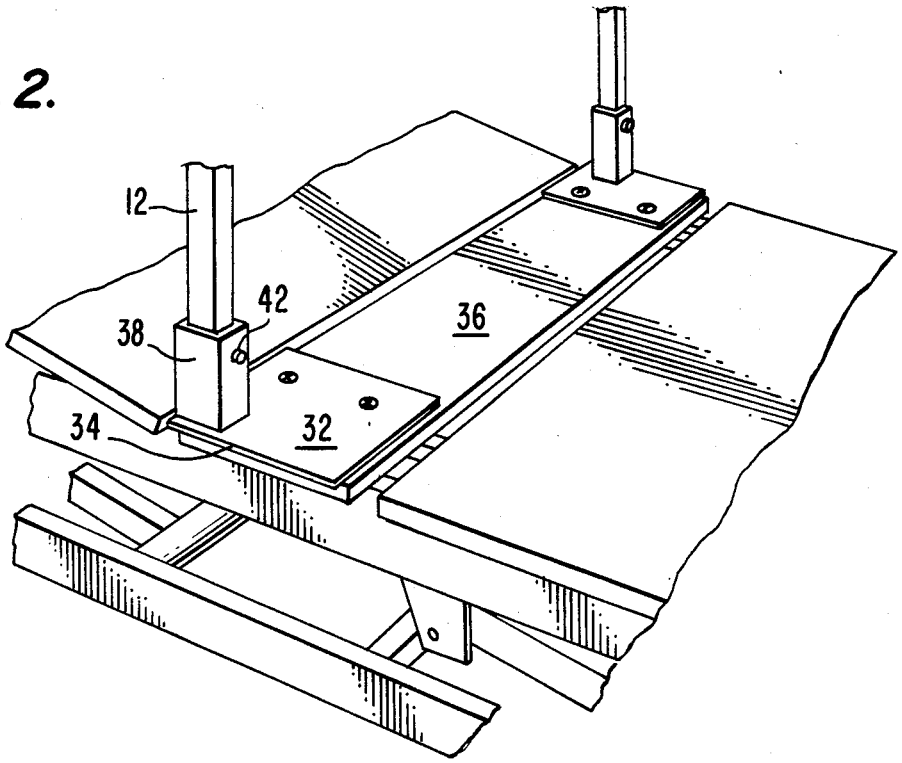

CONVENIENCE BAR ASSEMBLY FOR HOSPITAL BED

BACKGROUND OF THE INVENTION

1. Field of the Invention

The present invention relates to a convenience bar assembly for a hospital bed which assists patients in accomplishing certain tasks on their own without the aid of a nurse.

2. Description of the Background Art

Hospitalized patients are often too ill, invalid or obese to perform many tasks while in bed which for a relatively strong and healthy individual would be rather simple, such as rising from or turning in the bed.

Devices are known in the art which are designed to help patients more easily overcome such difficulties. For example, expired U.S. Pat. No. 3,310,817 to Harding discloses an invalid aid stand which rests on the floor and is unconnected to the bed. The Harding stand has a pair of crossbars, one extending over the top of the bed and one extending underneath the bed. Since such a stand rests on the floor and has a crossbar extending underneath the bed, movement of the bed is difficult without disassembling the stand. The undercarriages of modern adjustable hospital beds restrict movement of a stand having a crossbar extending under the bed. It is therefore difficult, if not impossible, to move the stand out of the way without disassembly of the stand if unrestricted access to the patient is required, such as when the patient needs to be lifted out of the bed.

There remains a need in the art for a convenience bar for a hospital bed which does not prevent easy movement of the bed, and which may be easily moved out of the way when unrestricted access to the patient is required.

SUMMARY OF THE INVENTION

In accordance with the present invention, a convenience bar assembly for a hospital bed comprises a generally U-shaped member including two arms adapted for generally vertical orientation and a horizontal cross-member connecting the arms. Means for attaching the lowermost ends of the arms of the U-shaped member to opposite sides of the bed are provided so that the horizontal cross-member is oriented transversely over the bed. A horizontal support bar and connecting means swingably connecting the horizontal support bar to the horizontal cross-member are provided so that the horizontal support bar hangs below the horizontal cross-member when the horizontal support bar is at rest.

BRIEF DESCRIPTION OF THE DRAWINGS

FIG. 1 is a perspective view showing a convenience bar assembly according to the invention mounted on an adjustable hospital bed.

FIG. 2 is an elevational view of mating means for attaching a convenience bar assembly according to the invention to an adjustable hospital bed frame.

DETAILED DESCRIPTION OF THE PREFERRED EMBODIMENT

Figure 3:
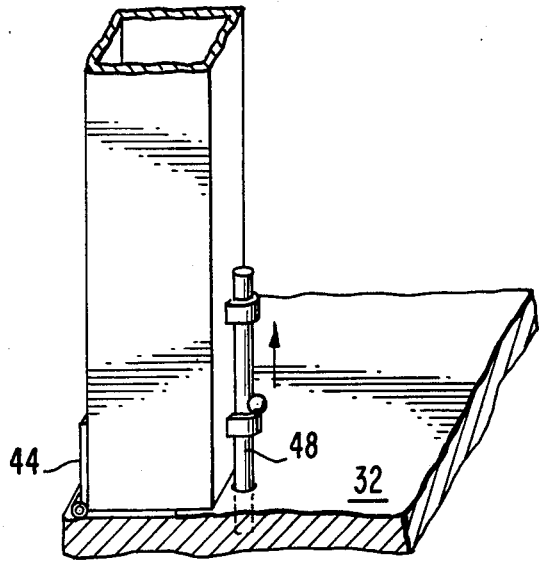
FIG. 3 is a cross-sectional view of a hinged means for attaching a convenience bar assembly according to the invention to an adjustable hospital bed.

The present invention is particularly well suited for use with an adjustable hospital bed 10 as shown in FIG. 1. According to the invention, a convenience bar assembly for a hospital bed includes a pair of vertically oriented arms 12 which are connected by a horizontal cross-member 16. The arms 12 may be connected to horizontal cross-member 16 by any suitable means, such as by welding. Alternatively, arms 12 and cross-member 16 may be formed from a single piece of suitable material such as metal tubing. As shown, arms 12 and connecting horizontal cross-member 16 form a generally U-shaped member.

Suspended from the horizontal cross-member 16 is a horizontal support bar 18. The horizontal support bar 18 is connected to the horizontal cross-member 16 by swingable connecting means which may include, for example, chain 20. One end of chain 20 is connected to horizontal cross-member 16 by means of clamp 22 at a generally central location along the horizontal cross-member. The other end of chain 20 is connected to horizontal support bar 18 by a generally V-shaped member having a peak 24 and a pair of arms 26 and 28, the lowermost ends of which are connected to opposite ends of the horizontal support bar 18. The swingable connecting means allow the horizontal support bar 18 to hang below the horizontal cross-member 16 when the horizontal support bar 18 is at rest.

A chain is a particularly preferred suspending means for horizontal support bar 18, since the chain is swingable in all directions.

The swingable chain connection of horizontal support bar 18 is positioned to be easily grasped by a patient so as to assist the patient in pulling himself upward from the bed in order to, for example, rise from the bed, turn in the bed, or rise to a position for effective coughing.

The distance between horizontal support bar 18 and horizontal cross-member 16 may be easily adjusted by means such as S-shaped hook 30 in order to vary the height of horizontal support bar 18 to make it easily accessible to patients of varying sizes.

The lower ends of arms 12 are connected to a typical bedframe by means which may include base plates 32. See FIG. 2. Base plates 32 are attached to opposite sides of a stationary portion 36 of an adjustable hospital bed 10 by any suitable means such as by nuts and bolts or welding. The outer edges 34 of base plates 32 extend outwardly a sufficient distance from that portion 36 of the bedframe to which they are connected, to allow sufficient space outside the perimeter of the bed's mattress M for connecting the base plate 32 to arms 12.

According to one embodiment, the means connecting base plates 32 to corresponding arms 12 include vertical tubular connecting members 38. According to this embodiment, vertical tubular connecting members 38 are sized to mate with and complementarily fit around the outer end portions of corresponding arms 12. If desired, a removable pin 42 may be provided for each of connecting members 38, the pin fitting through and mating with corresponding openings in the tubular connecting members 38 and corresponding arms 12 to selectively lock the arms in place within the vertical tubular connecting members.

According to this embodiment, if unrestricted access to the patient is desired, pins 42 are removed from connecting members 38, and the arms of the U-shaped member are lifted out of the vertical tubular connecting members, allowing the U-shaped member to be lowered outside the perimeter of the bed.

According to another embodiment, arms 12 are connected to corresponding base plates 32 by hinged members 44. See FIG. 3. Hinged members 44 permit pivoting movement of the U-shaped member from a position wherein the arms of the U-shaped member are oriented vertically to a position wherein the arms are oriented generally horizontally and parallel with the sides of the bed. The U-shaped member is selectively secured in a vertical position by suitable means such as slidable bolts 48 extending into corresponding keeper openings in base members 32. According to this embodiment, the U-shaped member may be pivoted towards the back of the bed after moving bolts 48 upwardly and out of the keeper openings in base plates 32, to provide unrestricted access to the patient.

Figure 4A:
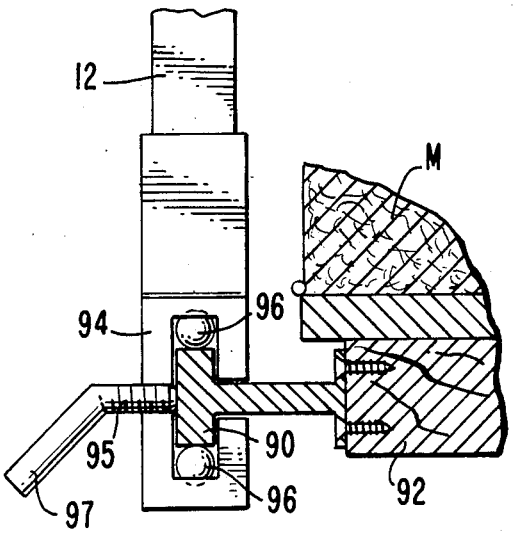
FIG. 4*a* is a cross-sectional view of a sliding means for attaching a convenience bar assembly according to the invention to an adjustable hospital bed.
Figure 4B:
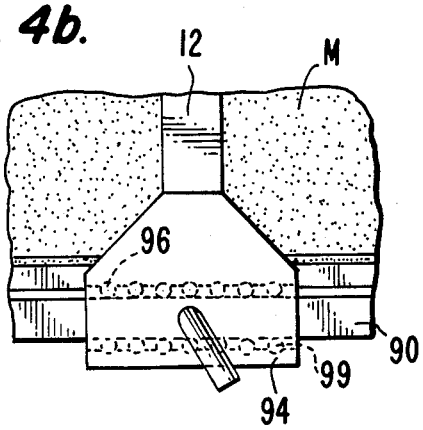
FIG. 4*b* is an elevational view, partially schematic, of the sliding attachment shown in FIG. 4*a*.

In one embodiment, the U-shaped member may be slidably mounted on a horizontal bed frame. See FIGS. 4*a* and 4*b*. According to this embodiment, a track 90 may be mounted on opposite sides of the bed on bedframe member 92, the tracks extending generally parallel with bedframe member 92 from a position adjacent bedframe member 36 up to about the head of the bed, i.e., the tracks extend along about the upper one-third of the bed. The tracks may, however, extend along the entire length of the bed. The U-shaped member is slidably connected to the tracks 90 by means of C-clamp followers 94 attached to the lower ends of corresponding arms 12. A plurality of ball bearings 96 separate the upper and lower bearing surfaces of track 90 from the upper and lower bearing surfaces of the follower 94 to facilitate movement of the U-shaped member along the tracks. According to this embodiment, the U-shaped member may be slid towards the head of the bed when unrestricted access to the patient is desired, or to position the U-shaped member at any desired location along the tracks. A pressure lock screw 95 is provided for selectively fixing the position of the U-shaped member long track 90. Lock screw 95 is turned within a corresponding mating opening infollower 94 by handle 97. Pressure applied by screw 95 against track 90 holds the U-shaped member in place when desired.

Figure 5:
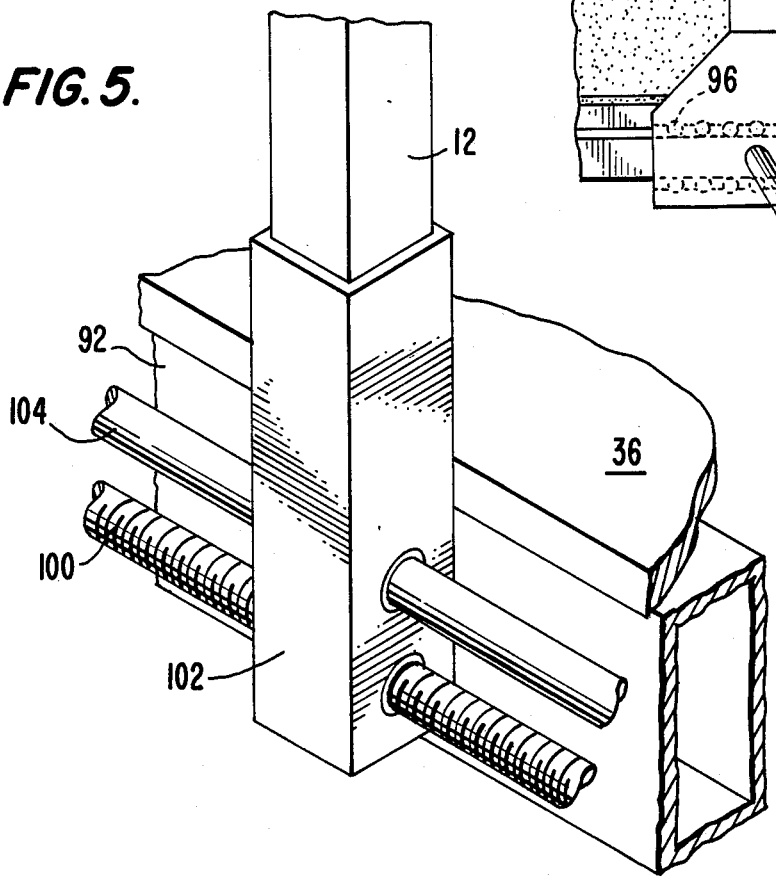
FIG. 5 is a perspective view with portions broken away of rotatable screw-type means for attaching a convenience bar assembly according to the invention to an adjustable hospital bed.

In another embodiment, tracks 90 are replaced by rotatable screws 100 connected to bedframe member 92 on opposite sides of the bed and extending from a position adjacent bedframe member 36 up to about the head of the bed. See FIG. 5. The screws 100 turn within complementary connecting members 102 to which corresponding arms 12 are attached. The screws 100 may be motor driven or crank driven to position the U-shaped member at any desired location along the screws, or to provide unrestricted access to the patient. According to this embodiment, arms 12 may be additionally supported by support rods 104 attached to bedframe member 92 and positioned parallel with corresponding rotatable screws 100. Connecting members 102 are slidably mounted on support rods 104 by means of corresponding passageways in connecting members 102 through which rods 104 pass.

In another embodiment, each of the lower ends of arms 12 are attached to a side pivot plate 110 by suitable means such as welding. See FIG. 6. The side pivot plates 110 are rotatably connected to side bed frame members F by pivot bolts 112.

Figure 6:
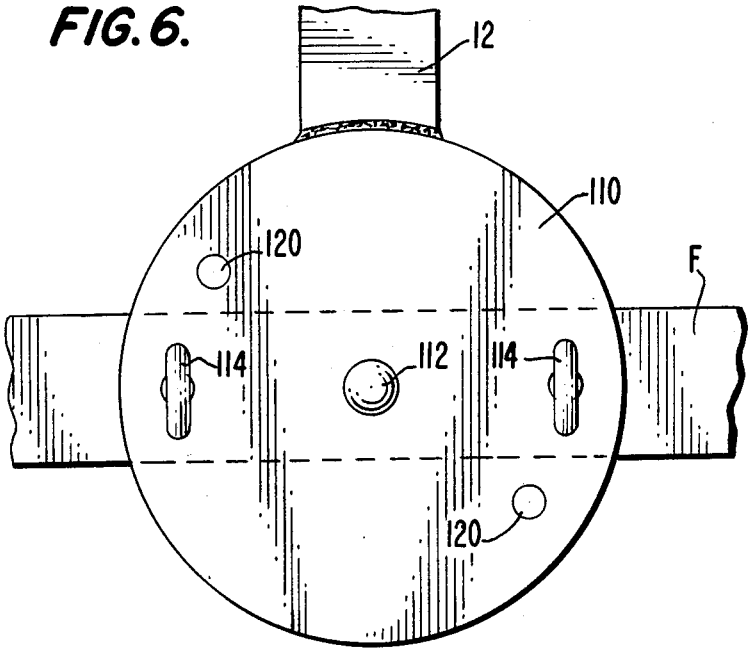
FIG. 6 is an elevational view, partially schematic, of a pivoting means with winged bolts for fixing a convenience bar according to the invention to an adjustable hospital bed.
Figure 7:
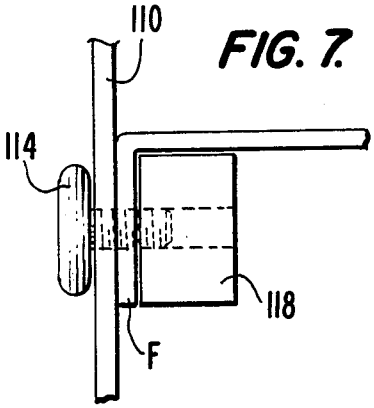
FIG. 7 is a cross-sectional detail vieew of the winged bolt fixing means shown in FIG. 6.

Means are provided for fixedly connecting pivot plates 110 to frame members F when it is desired to maintain arms 12 in a vertical position. These means may include one or more winged, threaded bolts 114 (two of which are shown in FIG. 6) extending through corresponding openings in pivot plate 110 and bed frame members F. See FIGS. 6 and 7. A frame reinforcing bar 118 may be provided for additional support for bed frame member F and pivot plate 110. As shown in FIG. 7, reinforcing bar 118 includes a corresponding opening for winged bolts 114. Alternatively, winged bolts 118 may be replaced by unthreaded bolts (not shown) with spring-operated bolts at their ends and corresponding keeper slots in reinforcing bar 118 to selectively hold the bolts in place.

According to this embodiment, if unrestricted access to a patient is desired, winged bolts 114 are removed from the corresponding openings in bed frame members F and reinforcing bars 118, allowing the U-shaped member to be pivoted towards the head of the bed. Additionally, openings 120, which correspond to winged bolts 114, may be provided in pivot plates 110, for detachably connecting pivot plates 110 to bed frame members F with arms 12 angularly positioned towards the head of the bed, e.g., 30° off vertical.

Figure 8:
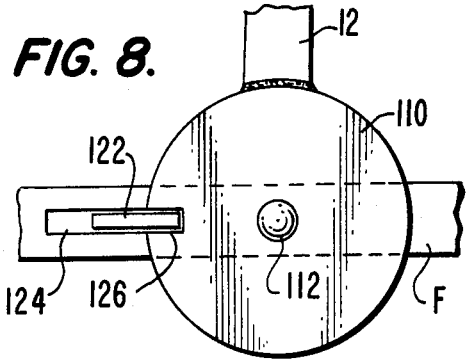
FIG. 8 is an elevational view, partially schematic, showing a pivoting convenience bar according to the invention with sliding bar means for fixing the bar to an adjustable hospital bed.

In an alternative embodiment, a sliding bar 122 is utilized to selectively fix arms 12 in a vertical position. See FIG. 8. According to this embodiment, bar 122 is slidably mounted in slot 124 in bed frame member F. Bar 122 fits into a complementary keeper slot 126 in pivot plate 110 to selectively fix arms 12 in a vertical position.

According to this embodiment, if unrestricted access to a patient is desired, bars 122 are moved out of keeper slots 126, allowing the U-shaped members to be pivoted towards the head of the bed.

Figure 9:
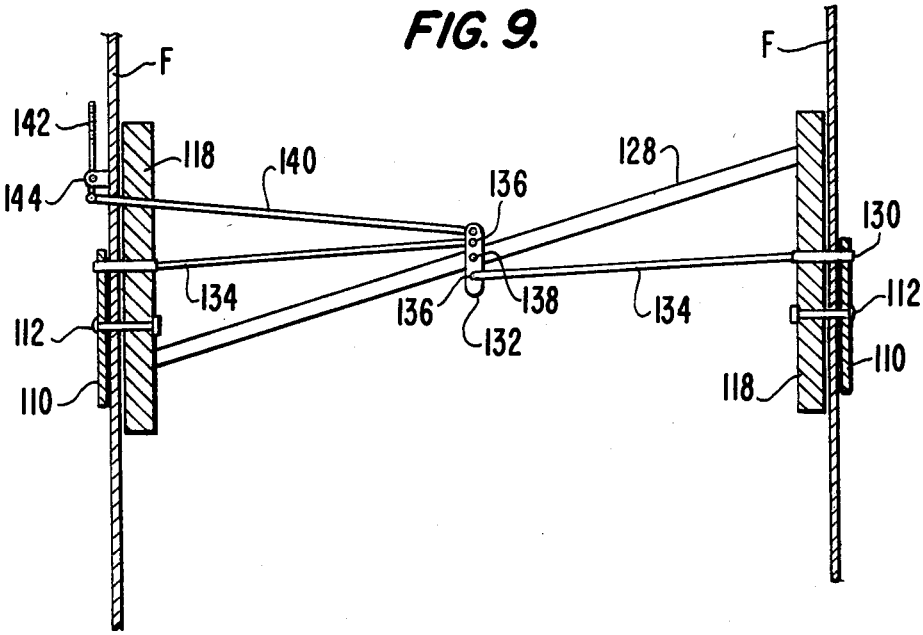
FIG. 9 is a partially cross-sectional, elevational view of means operable on one side of an adjustable hospital bed for fixing a pivoting convenience bar of the invention to the bed.

In yet another embodiment, means are provided for fixing or destabilizing the U-shaped member by one person on one side of the bed. See FIG. 9. The means may include transverse support member 128 extending between and connecting reinforcing bars 118, which are connected to bed frame members F on opposite sides of the bed. Pivot plates 110 are rotatably connected to frame members F and reinforcing bars 118 by pivot bolts 112 as above. However, pivot plates 110 are selectively stabilized and fixed to bed frame members F by means of slidable pins 130 which extend through complementary openings in pivot plates 110, bed frame member F and reinforcing bars 118.

Each of slidable pins 130 are connected to pivoting arm 132 by means of rods 134. Each of rods 134 is pivotably connected to pivoting arm 132 by means of rotatable pins 136, and pivoting arm 132 is pivotably connected to transverse support member 128 by means of rotatable pin 138. A control rod 140 is pivotably connected to lever handle 142 at the other end of control rod 140. Lever handle 142 is pivotably connected to the outside of bed frame members F by means of bracket 144, with control rod 140 extending through complementary openings in bed frame member F and support bars 118.

According to this embodiment, if unrestricted access to a patient is desired, handle 142 is moved outward from the bed frame member F which forces control rod 140 to move inwardly towards the center of the bed. Inward movement of control rod 140 cause pivoting arms 132 to rotate about pin 138. The rotation of pivoting arm 132 causes inward movement of rods 134 and slidable pins 130 towards the center of the bed. The U-shaped member may be pivoted towards the head of the bed when slidable pins 130 exit the complementary opening in pivot plates 110.

In order to further assist the patient while maneuvering in a hospital bed, hand-grasping members 52 may be provided on either or both of arms 12. See FIG. 1. Hand-grasping members 52 are preferably generally arcuately shaped with their ends fixedly attached to respective arms 12 by any suitable means such as by welding. Hand-grasping members 52 are preferably positioned to extend towards the head of the bed, thereby providing maximum access to the patient.

The arms 12 of the U-shaped member are particularly suitable for mounting various attachments such as upwardly oriented hooks 56 for hanging intravenous fluid bottles. Suitable brackets 59 may be provided on corresponding arms 12 below hooks 56 for mounting intravenous fluid pumps 60. Clips 62, 64 and 66 may be screw mounted on either of the arms 12 for mounting a nurse call button, a television selection panel and positioning controls for the adjustable bed. A bracket 68 may be mounted on either of the arms 12 for holding a fluid dispenser such as a thermos bottle 70. Below bracket 68 may be mounted a ring 72 adapted to hold a plurality of paper cups 74. A bracket 76 may be mounted on either of the arms 12 for mounting a box of facial tissues 78. A lamp 80 may also be mounted on either of the arms 12 by means of bracket 82.

Although a convenience bar assembly according to the invention has been particularly described for mounting on an adjustable hospital bed, the invention may be adapted for any size or type of bed by merely varying the dimensions of the assembly and providing suitable connections to the bed frame.

The convenience bar assembly of the present invention provides assistance to patients in performing tasks which they otherwise might not be able to undertake. The invention permits easy movement of a bed to which it is attached, and provides a support for additional devices which the patient may require for his care or comfort and considerable time saving for nurses.

Since many modifications, variations and changes in detail may be made to the described embodiment, it is intended that all matter in the foregoing description and shown in the accompanying drawings be interpreted as illustrative and not in a limiting sense.

What is claimed is:

1. In combination, a convenience bar assembly and a hospital bed comprising:

(a) a generally U-shaped member including two arms oriented in a generally vertical orientation and a horizontal cross-member connecting the arms, the arms being adapted for mounting thereon a plurality of attachments for a patient's use;

(b) means for attaching the lowermost ends of the arms of the U-shaped member to an adjustable hospital bed adjacent opposite sides of the bed so that the horizontal member is oriented transversely over the bed, the adjustable bed including a raisable portion and a floor-engaging portion, the arms of the U-shaped member being attached to a portion of the raisable portion of the bed which remains stationary with respect to a patient during adjustment of the bed, the attaching means being spaced apart from head and foot portions of the bed, the attaching means being selectively pivotable for selectively pivoting the U-shaped member towards the head portion of the bed without laterally displacing the arms of the U-shaped member with respect to the bed to permit unrestricted access to a patient in the bed;

(c) a horizontal support bar; and (d) means for swingably connecting the horizontal support bar to the horizontal cross-member so that the horizontal support bar hangs below the horizontal cross-member when the horizontal support bar is at rest.

2. The combination of claim 1 wherein the connecting means is adjustable to permit variations in the distance between the horizontal support bar and the horizontal member.

3. The combination of claim 2 wherein the connecting means include a generally V-shaped member having a peak and two arms, the lowermost ends of the arms being connected to opposite ends of the horizontal support bar, the connecting means further including a chain connecting the peak of the V-shaped member with the horizontal cross-member.

4. The combination of claim 1 wherein the connecting means include a generally V-shaped member having a peak and two arms, the lowermost ends of the arms being connected to opposite ends of the horizontal support bar, the connecting means further including a chain connecting the peak of the V-shaped member with the horizontal cross-member.

5. The combination of claim 1 wherein the means for attaching the lowermost ends of the arms of the U-shaped member include means for selectively pivoting the U-shaped member from a position wherein the arms of the U-shaped member are securely oriented in a vertical direction, to a position wherein the arms of the U-shaped members are oriented generally horizontally and generally parallel with the sides of the bed.

6. The combination of claim 1 further including at least one generally arcuately shaped hand-grasping member on at least one of the arms of the U-shaped member, the hand-grasping member having two ends fixedly attached to one of the arms of the U-shaped member and the hand-grasping member being positioned to extend towards the head of the bed.

7. The combination of claim 1 further comprising an upwardly oriented hook means attached to at least one of the arms of the U-shaped member for hanging an intravenous fluids bottle.

8. The combination of claim 7 further including means for mounting an intravenous fluid pump on the arm to which the hook is attached and below the hook.

9. The combination of claim 1 further including means for mounting a nurse call button on one of the arms of the U-shaped member.

10. The combination of claim 1 further including means for mounting a television selection panel on one of the arms of the U-shaped member.

11. The combination of claim 1 further including means for mounting adjustable bed positioning controls on one of the arms of the U-shaped member.

12. The combination of claim 1 further including means for mounting a fluid-dispensing container on one of the arms of the U-shaped member.

13. The combination of claim 12 further including a horizontally mounted ring attached to one arm of the U-shaped member below the means for mounting the fluid-dispensing container, the ring being adapted to hold a plurality of paper cups.

14. The combination of claim 1 further including means for mounting a facial tissue dispenser on one arm of the U-shaped member.

15. The combination of claim 1 further including means for mounting a lamp on one arm of the U-shaped member.

16. A convenience bar assembly for a hospital bed comprising:

(a) a generally U-shaped member including two arms oriented in a generally vertical orientation and a horizontal cross-member connecting the arms, the arms having mounted thereon a plurality of attachments for a patient's use;

(b) a fluid-dispenser for dispensing a drinking fluid, mounted on one of the arms of the U-shaped member;

(c) means for holding a cup, mounted below the fluid-dispensing container on said one of the arms of the U-shaped member;

(d) means attached to the U-shaped member for hanging an intravenous fluids bottle;

(e) a control member mounted on one of the arms of the U-shaped member for adjusting the position of the adjustable bed;

(f) means for attaching the lowermost ends of the arms of the U-shaped member to an adjustable hospital bed adjacent opposite sides of the bed so that the horizontal member is oriented transversely over the bed, the adjustable bed including a raisable portion and a floor-engaging portion, the arms of the U-shaped member being attached to a portion of the raisable portion of the bed which remains stationary with respect to a patient during adjustment of the bed, the attaching means being spaced apart from head and foot portions of the bed, the attaching means being selectively pivotable for selectively pivoting the U-shaped member towards the head portion of the bed without laterally displacing the arms of the U-shaped member with respect to the bed to permit unrestricted access to a patient in the bed;

(g) a hand-grasping member respective mounted on each of the arms of the U-shaped member, each hand-grasping member extending towards the head of the bed;

(h) a horizontal support bar; and (i) means for swingably connecting the horizontal support bar to the horizontal cross-member so that the horizontal support bar hangs below the horizontal cross-member when the horizontal support bar is at rest.

* * * * *